US007020993B2

(12) United States Patent
Pritchard

(10) Patent No.: US 7,020,993 B2
(45) Date of Patent: Apr. 4, 2006

(54) DISPLAY APPARATUS

(75) Inventor: Adrian Pritchard, Basildon (GB)

(73) Assignee: D & D Displays & Exhibitions Limited, Essex (GB)

( * ) Notice: Subject to any disclaimer, the term of this patent is extended or adjusted under 35 U.S.C. 154(b) by 0 days.

(21) Appl. No.: 10/344,170

(22) PCT Filed: Feb. 15, 2001

(86) PCT No.: PCT/GB01/00618

§ 371 (c)(1),
(2), (4) Date: Aug. 8, 2003

(87) PCT Pub. No.: WO02/13171

PCT Pub. Date: Feb. 14, 2002

(65) Prior Publication Data

US 2004/0074123 A1 Apr. 22, 2004

(30) Foreign Application Priority Data

Aug. 8, 2000 (GB) ..... 0019306

(51) Int. Cl.
*G09F 15/00* (2006.01)

(52) U.S. Cl. ..... 40/610; 248/329; 40/594; 40/600

(58) Field of Classification Search ..... 40/610, 40/603, 611.01, 611.05, 611.11, 514, 515, 40/601, 617, 594, 600; 211/202; 160/368.1, 160/351

See application file for complete search history.

(56) References Cited

U.S. PATENT DOCUMENTS

| | | | | |
|---|---|---|---|---|
| 264,751 | A * | 9/1882 | Potts | 211/45 |
| 4,658,560 | A * | 4/1987 | Beaulieu | 52/646 |
| 4,758,042 | A * | 7/1988 | Liu | 296/97.7 |
| 4,802,523 | A * | 2/1989 | Scholten et al. | 160/354 |
| 5,358,025 | A * | 10/1994 | Wood | 160/368.1 |
| 5,850,864 | A * | 12/1998 | Decker | 160/268.1 |
| 6,257,307 | B1 * | 7/2001 | Tollivar | 160/368.1 |
| 6,758,354 | B1 * | 7/2004 | Carletti | 211/189 |

* cited by examiner

*Primary Examiner*—Joanne Silbermann
(74) *Attorney, Agent, or Firm*—Barnes & Thornburg LLP

(57) ABSTRACT

Display apparatus comprises a support frame having elongate frame members (1) pivotally interconnected at nodes (2) and at their crossing mid points so that the apparatus is capable of being transformed between a compact condition for storage or transport and an erected condition in which display panels (3) can be attached to the frame. The nodes (2) are arranged in vertically spaced groups and the uppermost node (2) of each group carries a reel (9) in which is wound a metal tape (8) withdrawable from the reel (9) to support the display panels (3) on the frame by magnetic attraction.

11 Claims, 3 Drawing Sheets

DISPLAY APPARATUS

This invention relates to display apparatus.

A known form of display apparatus comprises a support frame having tubular frame members extending between nodes of the frame. The frame members are pivotally interconnected at the nodes and at their mid-points, to enable the frame to be converted so as to occupy either a compact collapsed condition for storage or transport, or an operative extended position in which separate metal bars are applied to and span the nodes, in order to assist in the support of display panels applied to the frame. An object of the invention is to provide display apparatus avoiding the need for the separate metal bars of the prior art.

According to the invention display apparatus comprises a support frame having frame members extending between nodes of the frame and elongated members for spanning the nodes to receive display panels on at least a front of the frame, characterised in that the elongated members are in the form of tapes withdrawable from reels carried by the frame.

Each reel may have a spindle around which the tape is wound, and a housing into which the tape is retractable and from which it is extendable, the housing being mounted on the frame.

Preferably, the nodes are arranged in a plurality of groups, with the nodes of each group being arranged in a substantially vertical line and with the groups being horizontally spaced. In this case, each reel is preferably mounted on the uppermost node of a corresponding group of nodes, enabling the tape to be withdrawn from the reel and, starting from the top of the frame, to span any chosen number of nodes of the group.

The tape may be of metal, about 25 mm wide, in order to receive display panels having magnetic strips. Each tape preferably retracts into the corresponding reel under spring assistance, the end of the tape having or carrying a formation (such as a projection) engageable with a cooperating formation (such as a socket) on each node. Each node may also carry a magnet, for retaining the tape against the node.

The display apparatus is preferably collapsible in the manner of "pop-up" display apparatus. When the invention is applied to such "pop-up" display apparatus, the tape is preferably automatically withdrawn from the reels or retracted back into the reels, on erection or collapse of the display apparatus.

Figure 1:
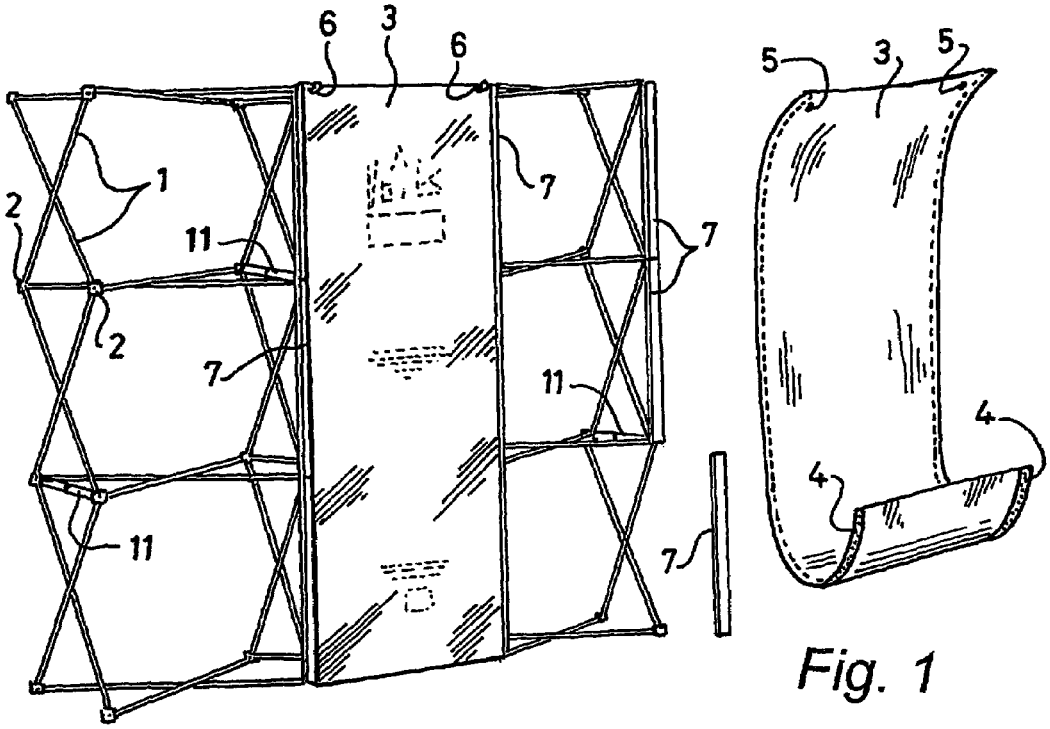
Figure 2:
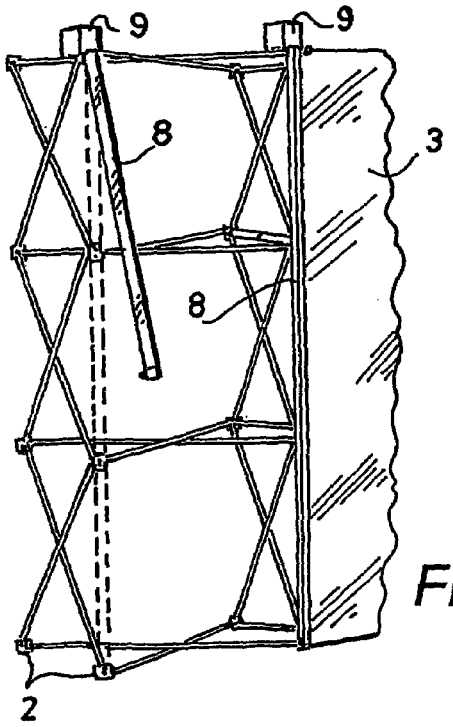
Figure 3:
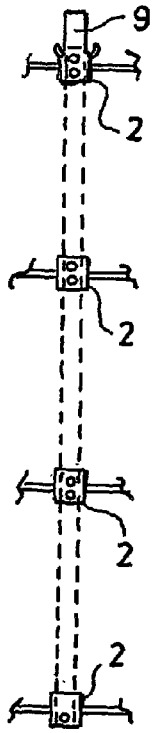
Figure 4:
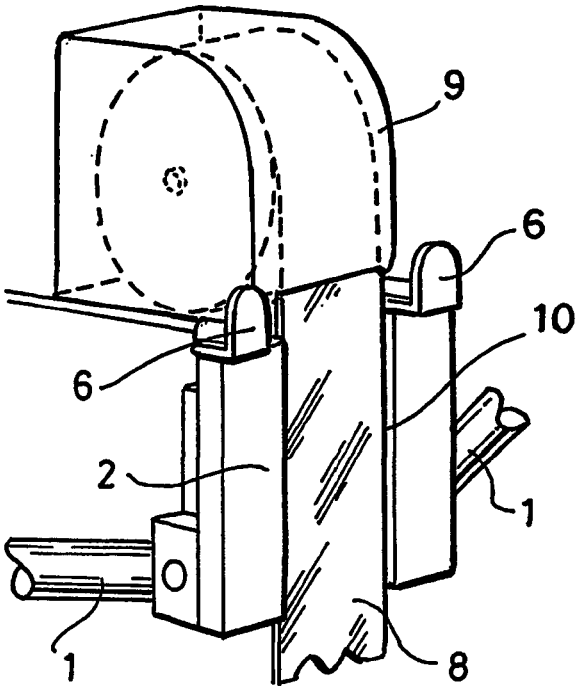
Figure 5:
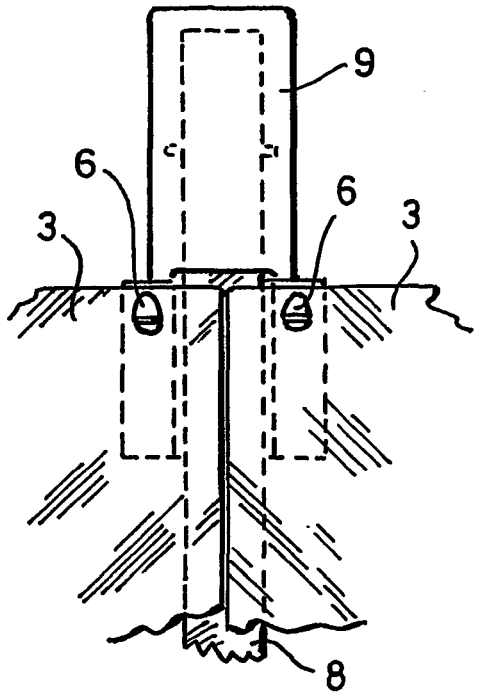
Figure 6:
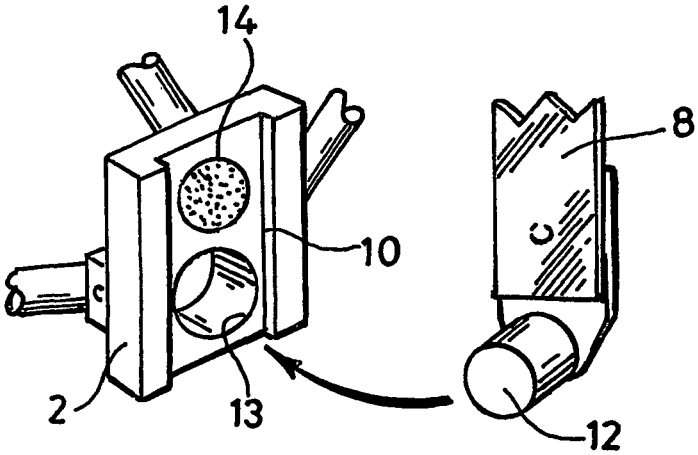
Figure 7:
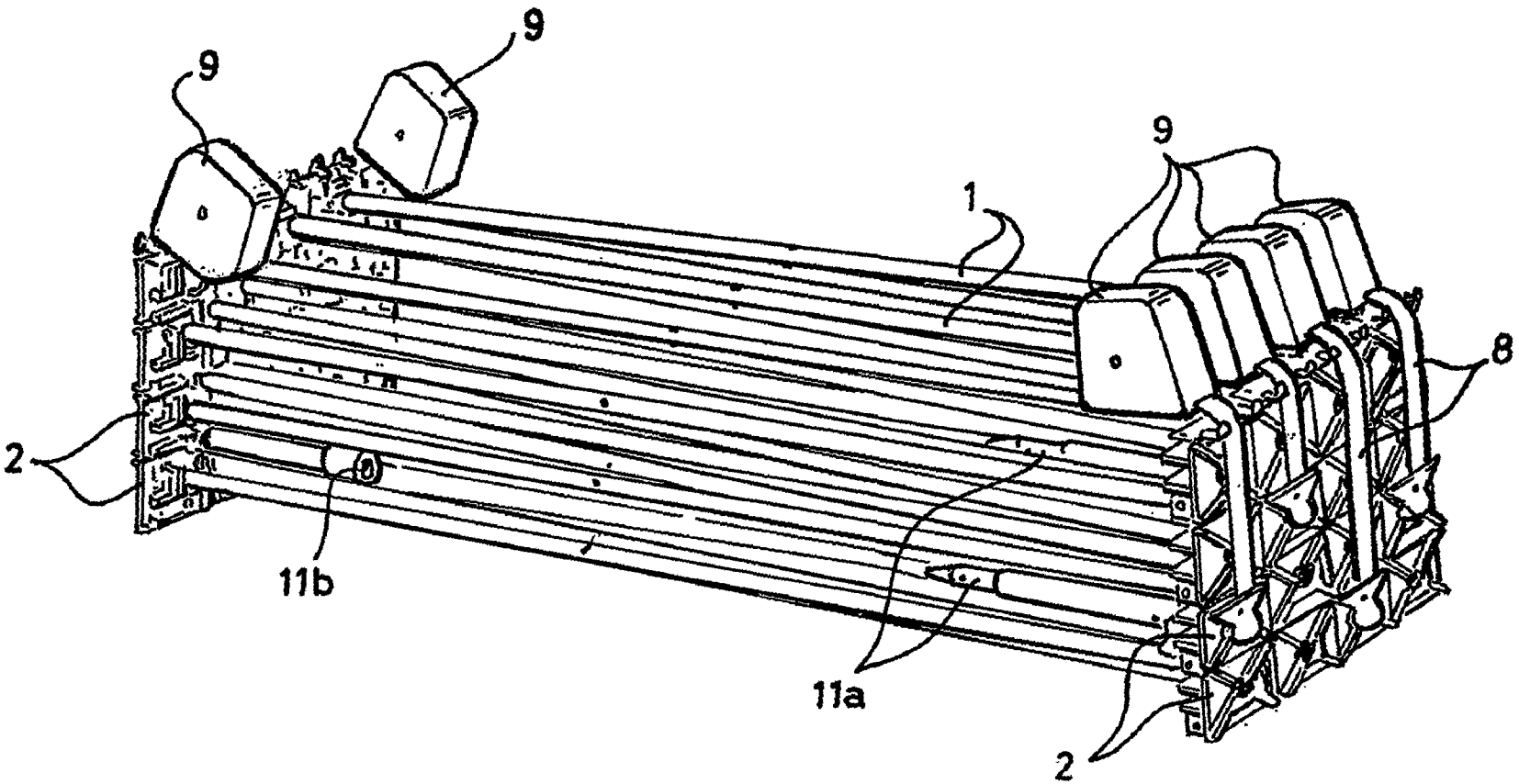

The invention will now be further described, by way of example, with reference to the accompanying drawings, in which:

FIG. 1 is a perspective view of conventional display apparatus,

FIG. 2 is a perspective view showing display apparatus according to the invention, FIG. 3 is a detail of FIG. 2, FIG. 4 shows, to an enlarged scale, a reel accommodating a metal tape, FIG. 5 shows two adjacent display panels attached to the metal tape, FIG. 6 illustrates a detail showing how one end of the tape can be fastened to a node of the display apparatus, and FIG. 7 illustrates the display apparatus of FIG. 2 in a collapsed condition.

Referring to FIG. 1, the known form of display apparatus is of the "pop-up" form and comprises a support frame having light alloy tubular frame members 1 which are pivotally interconnected at nodes 2 and at their crossing mid-points so that the display apparatus is capable of being transformed from a compact condition for storage or transport to an erected condition (illustrated in FIG. 1) in which display panels 3 are attached to the display apparatus. Each display panel 3 has, on each of its longer edges, a magnetic tape 4, and each display panel 3 also has two holes 5 by which the display panel 3 can be hung on hooks 6 projecting from the upper nodes of the display apparatus.

In the erected condition of the display apparatus, the nodes 2 are arranged in groups, with the nodes in each group being vertically spaced and with the groups being horizontally spaced. Metal bars 7, each having a length corresponding to the vertical spacing between adjacent nodes in the group, are attached to and span the nodes 2 which are in the form of plastics mouldings. FIG. 1 shows the right-hand group of nodes spanned by two metal bars 7, with a third bar 7 about to be applied to and span the two lowest nodes of the group. After the bars 7 have been fitted to the frame in this manner, the panels 3 are hung from the hooks 6, the panel edges adhering to the bars 7 by the magnetic attraction of the tapes 4 to the bars 7.

To collapse the display apparatus of FIG. 1, the display panels 3 and the metal bars 7 are removed from the erected frame. Then, inter-engaging plug and socket connections 11 (which extend horizontally and interconnect nodes at the front and back of the frame) are separated, enabling the frame to be collapsed, with attendant pivoting of the frame members 1 at the nodes and at the crossing points of the frame members 1. In the collapsed condition of the frame, all of the nodes at the front of the frame are grouped together in a cluster and all of the nodes at the back of the frame are similarly grouped together in a cluster, all the frame members 1 extending substantially parallel to one another in a compact bundle.

To overcome the need for the separate metal bars 7, the invention proposes the use of metal tapes 8 (FIG. 2) each withdrawable against spring loading from a corresponding reel 9. Each reel 9 has a spindle around which the tape 8 is would and a housing into which the tape is retractable and from which it is extendable. Each reel housing is mounted on the top node of a vertical group of nodes 2. In FIG. 2, one tape 8 is shown partially extended and another is shown fully extended with its lower end clipped into the lowest node 2. A display panel 3 is applied to the frame as before, being supported on hooks 6 and being retained by the magnetic attraction of the strips 4 against the metal tape 8. Along each edge, the display panel 3 overlaps half the width of the tape 8, to leave the other half of the tape 8 ready to accept the adjacent display panel 3. Thus, adjacent display panels 3 abut to form a substantially continuous display surface, as illustrated in FIG. 5. FIG. 3 shows the tape fully retracted within the reel 9 and its extended position is shown in broken lines.

FIG. 4 illustrates how the reel is mounted on the top node 2 of a group, and how each node 2 may have a shallow channel 10 to receive the tape 8.

FIG. 6 illustrates the tape end which has a formation (in this case a cylindrical stud 12) engageable in a cooperating formation (in this case a cylindrical bore or recess 13) in each node 2. Thus, the tape 8 can be withdrawn to a chosen length and the end retained in a chosen node of the corresponding group. Each node may also have a magnet 14 to retain the passing length of tape 8 against the node 2.

The inventive display apparatus of FIGS. 2 to 6 is collapsed in the same way as the conventional display apparatus of FIG. 1, and FIG. 7 shows the inventive display apparatus in a collapsed condition in which the plug formations 11*a* are separated from their respective socket formations 11*b* and the frame members 1 extend substantially parallel to one another in a compact bundle. However, in the inventive display apparatus, it is not necessary to detach the tapes 8 from the nodes 2, although this can be done. If the tapes 8 are left extended, they automatically retract into the reels 9 under the spring loading as the frame is collapsed. On re-erection of the frame, the plug and socket formations 11*a*, 11*b* are engaged and the tapes are withdrawn from the reels, against the spring bias, to re-create the original configuration, ready for application of the display panels 3.

The invention claimed is:

1. Display apparatus comprising a support frame having frame members extending between nodes of the frame and elongated members for spanning the nodes to receive display panels on at least a front of the frame, characterised in that the elongated members are in the form of tapes withdrawable from reels carried by the frame.

2. Display apparatus according to claim 1, wherein each reel has a spindle around which the tape is wound, and a housing into which the tape is retractable and from which it is extendable, the housing being mounted on the frame.

3. Display apparatus according to claim 2, wherein each tape retracts into the corresponding reel housing under spring assistance.

4. Display apparatus according to claim 1, wherein the nodes are arranged in a plurality of groups, with the nodes of each group being arranged in a substantially vertical line and with the groups being horizontally spaced.

5. Display apparatus according to claim 4, wherein each reel is mounted on the uppermost node of a corresponding group of nodes, enabling the tape to be withdrawn from the reel and, starting from the top of the frame, to span any chosen number of nodes of the group.

6. Display apparatus according to claim 1, wherein the tape is of metal in order that display panels having magnetic strips can be detachably mounted on the frame.

7. Display apparatus according to claim 6, wherein each node carries a magnet, for detachably retaining the tape against the node.

8. Display apparatus according to claim 6, wherein the apparatus includes a plurality of substantially flat display panels, each having respective magnetic strips for attracting the panels to the tape thereby detachably to retain the panels on the support frame.

9. Display apparatus according to claim 1, wherein the end of the tape has or carries a formation engageable with a cooperating formation on each node.

10. Display apparatus according to claim 1, wherein the apparatus is capable of being repeatedly transformed between a collapsed compact condition for transport or storage and an operative erected condition for receiving the display panels.

11. Display apparatus according to claim 10, wherein the tape is automatically withdrawn from the reels on conversion of the apparatus from the collapsed condition to the erected condition and is automatically retracted into or onto the reels on conversion of the apparatus from the erected condition to the collapsed condition.

* * * * *